United States Patent [19]

Satchell, Jr.

[11] 4,090,947

[45] May 23, 1978

[54] HYDROGEN DONOR DILUENT CRACKING PROCESS

[75] Inventor: Donald P. Satchell, Jr., Morenci, Ariz.

[73] Assignee: Continental Oil Company, Ponca City, Okla.

[21] Appl. No.: 822,573

[22] Filed: Aug. 8, 1977

Related U.S. Application Data

[63] Continuation-in-part of Ser. No. 693,047, Jun. 4, 1976, abandoned.

[51] Int. Cl.[2] ..... C10G 13/22; C10G 37/02

[52] U.S. Cl. ..... 208/56; 208/50; 208/53

[58] Field of Search ..... 208/50, 53, 56

[56] References Cited

U.S. PATENT DOCUMENTS

| | | | |
|---|---|---|---|
| 3,238,118 | 3/1966 | Arey et al. | 208/56 |
| 3,245,900 | 4/1966 | Paterson | 208/56 |
| 3,617,513 | 1/1969 | Wilson et al. | 208/56 |

*Primary Examiner*—Herbert Levine

*Attorney, Agent, or Firm*—Richard W. Collins

[57] ABSTRACT

A hydrogen donor diluent cracking process for converting hydrogen deficient residual petroleum oils to more valuable distillates. A premium coker gas-oil is utilized as the hydrogen donor diluent.

8 Claims, 3 Drawing Figures

HYDROGEN DONOR DILUENT CRACKING PROCESS

This application is a continuation-in-part of application Serial No. 693047 filed June 4, 1976 now abandoned.

BACKGROUND OF THE INVENTION

1. Field of the Invention

This invention relates to a process for upgrading residual petroleum oils to more valuable products, and more particularly to a process wherein hydrogen deficient residual petroleum oils are thermally cracked in the presence of a hydrogen donor diluent.

2. Description of the Prior Art

It is known in the art to upgrade hydrogen deficient residual petroleum oils (resid) by thermally cracking the resid in admixture with a hydrogen donor diluent. The hydrogen donor diluent is a material, generally aromatic-napthenic in nature, that has the ability to take up hydrogen under mild hydrogenation conditions and to readily release the hydrogen to a hydrogen deficient resid under thermal cracking conditions. One of the principal advantages of the hydrogen donor diluent cracking (HDDC) process is that it can upgrade resids which are not readily amenable to other conversion processes, and another principal advantage is that it can provide high conversions in the absence of a catalyst and with a minimum of coke deposition. The cracked materials produced by the HDDC process are readily recovered as desirable products including light ends and a gasoline fraction, and the hydrogen donor diluent can be recovered by fractionation of the cracked products and recycled through the hydrogenation step for reuse as donor diluent in the cracking unit.

The HDDC process is well known in the art, and a comprehensive description of the process, including materials, flows and operating conditions, appears in U.S. Pat. No. 2,953,513. Variations of the HDDC process, particularly as to the make-up of the hydrogen donor diluent, are described in U.S. Pat. Nos. 2,873,245 and 3,238,118. Hydrogen donors proposed in the prior art include relatively low boiling, pure, and expensive compounds such as naphthalene, tetralin, decalin, anthracene, and the like. These compounds have generally been considered unsatisfactory for a commercial operation because of their expense and other difficulties inherent in their use. More practical hydrogen donor diluents suggested by the prior art include certain distillate thermal tars which, upon partial hydrogenation, produce a good hydrogen donor material. However, even when distillate thermal tars are utilized as a hydrogen donor diluent, the hydrogen utilization, yields and selectivities have been such that the hydrogen donor diluent cracking process has been a marginal operation, and the process has not been extensively used commercially. A particular problem encountered using known hydrogen donor diluents is the tendency of the diluent to form coke in the cracking unit, and there has accordingly been a need for a more thermally stable hydrogen donor diluent.

SUMMARY OF THE INVENTION

According to the present invention, an HDDC process utilizes a heavy premium coker gas-oil as the hydrogen donor diluent. Heavy premium coker gas-oil has been found to have the proper structural characteristics to be relatively easily partially hydrogenated, and has been found to readily give up the added hydrogen to the cracked molecules formed in a thermal cracking furnace. Additionally, the heavy premium coker gas-oil is thermally stable and has less tendency to form coke under thermal cracking conditions compared to previously used hydrogen donor diluents.

DESCRIPTION OF THE PREFERRED EMBODIMENTS

Figure 1:
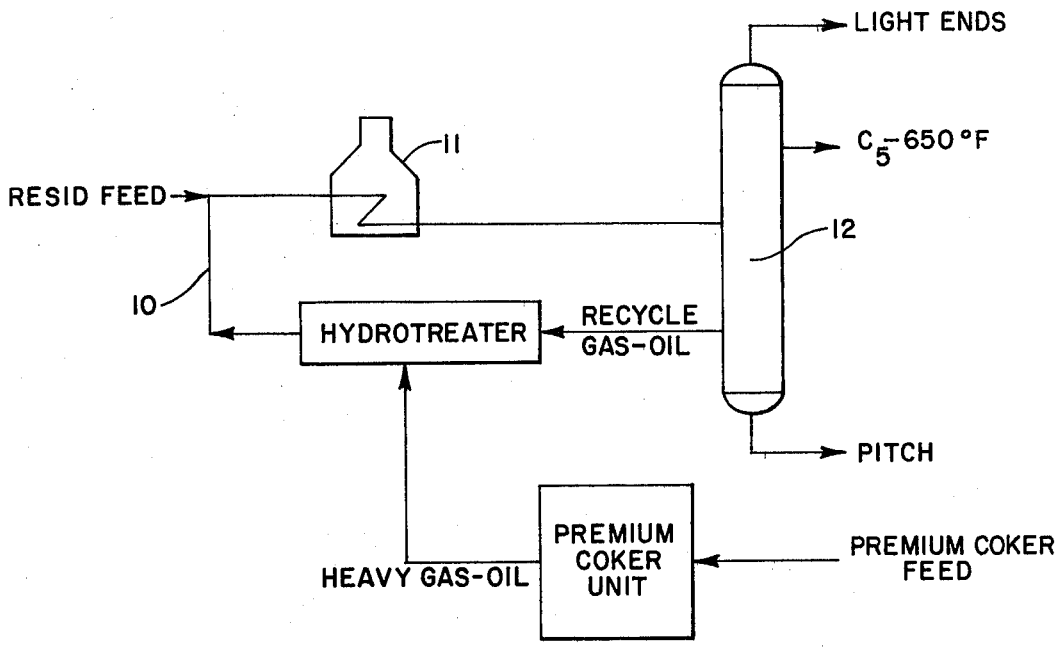
FIG. 1 is a schematic flow sheet illustrating the basic process of the invention.

The process conditions for the various embodiments of the invention described herein are those which are suitable for a conventional hydrogen donor diluent cracking operation. These process conditions include a diluent to feed ratio in the range of 0.1 to 5 volumes per volume, a combined feed rate to provide a residence time in the cracking furnace between a few seconds and a few minutes, a pressure preferably sufficient to maintain liquid phase conditions, and a temperature of from 800–1,000° F. Generally, the hydrogen consumption at a given resid conversion decreases with increasing reactor temperature. However, the tendency of the donor diluent and the cracked material to deposit coke in the cracking unit also increases with increasing reactor temperature, such that the optimum temperature for a given situation is often a compromise between resid conversion level and coke deposition. The process of this invention, and particularly the use of a heavy premium coker gas-oil as the hydrogen donor diluent, enables the process to be carried out at a higher temperature than could be utilized using prior art diluents. This is due to the improved thermal stability of premium coker gas-oil compared to the prior art diluent materials.

The diluent in accordance with the invention is produced in a premium coker unit which is operated at conditions such that the coke produced has a coefficient of thermal expansion of about five times $10^{-7}/°$ C or less. These conditions include a transfer line temperature from the coker furnace of about 900°–960° F, preferably from 920–945° F, a coke drum pressure of about 10 to 150 psig, preferably about 30 to 70 psig, a recycle ratio (furnace charge divided by fresh feed) of 1.2 to 2.5, and a premium coke feedstock such as thermal tar, decant oil from a fluid catalytic cracker, or other similar stream having comparable aromaticity and boiling range. A coke drum temperature of about 820°–900° F, preferably 840°–880° F, is normally obtained in a premium coker operation. Coke drum temperature is determined by measuring the temperature of the vapor stream from the coke drum. Operation of a premium coker unit under these conditions provides a source of heavy premium coker gas-oil which is an excellent donor in accordance with the invention. Preferably, light ends boiling up to about 650° F are removed from the stream prior to using it as a donor.

The feedstock for the process of this invention can be any residual petroleum stream which is amenable to thermal cracking. A preferred feedstock is the bottom fraction from a vacuum still used to reduce an atmospheric topped crude. This fraction includes all the material boiling above a selected point, which may be 950°-1050° F.

The hydrotreater can be a conventional one operating at a temperature of from 650°-700° F at a liquid hourly space velocity (LHSV) of from 0.5 to 4 and having a hydrogenation catalyst such as nickel molybdenum or cobalt molybdenum.

The donor cracking furnace can be operated at a temperature of from 800°-1,000° F, and preferably about 950°-975° F in most cases. Higher temperatures are possible, and conversion rates generally increase with higher temperatures, but the tendency of the feed to deposit coke in the furnace increases with increasing temperature, and in order to operate at temperatures much above 1,000° F the residence time in the furnace must be very short. The furnace pressure can vary considerably, but in a commercial operation the feed inlet pressure must be sufficient to allow for a substantial pressure drop through the furnace, and inlet pressures of several hundred psi are generally required. No particular advantage is provided by operating at extremely high pressures such as above 1,000 psi.

The ratio of residual feedstock to donor diluent going to the furnace can vary within the range of about 0.5 to 4 volumes of donor diluent for each volume of feed. Preferably, approximately equal volumes of residual feedstock and donor diluent are used.

In the process illustrated in FIG. 1, hydrogen donor diluent from line 10 is combined with a resid stream and fed to cracking furnace 11. The hydrogen deficient stream is thermally cracked in the presence of the hydrogen donor, and the cracked products are passed to a fractionator 12. In fractionator 12, the cracked products are separated into light ends, a gasoline fraction, gas-oil and pitch. The gas-oil fraction, which is predominantly donor diluent which has given up hydrogen during the cracking step, is passed to a hydrotreater where it is again hydrogenated and subsequently utilized as recycle donor diluent. A heavy gas-oil stream from a premium coker unit is utilized to provide fresh donor diluent to the process.

Figure 2:
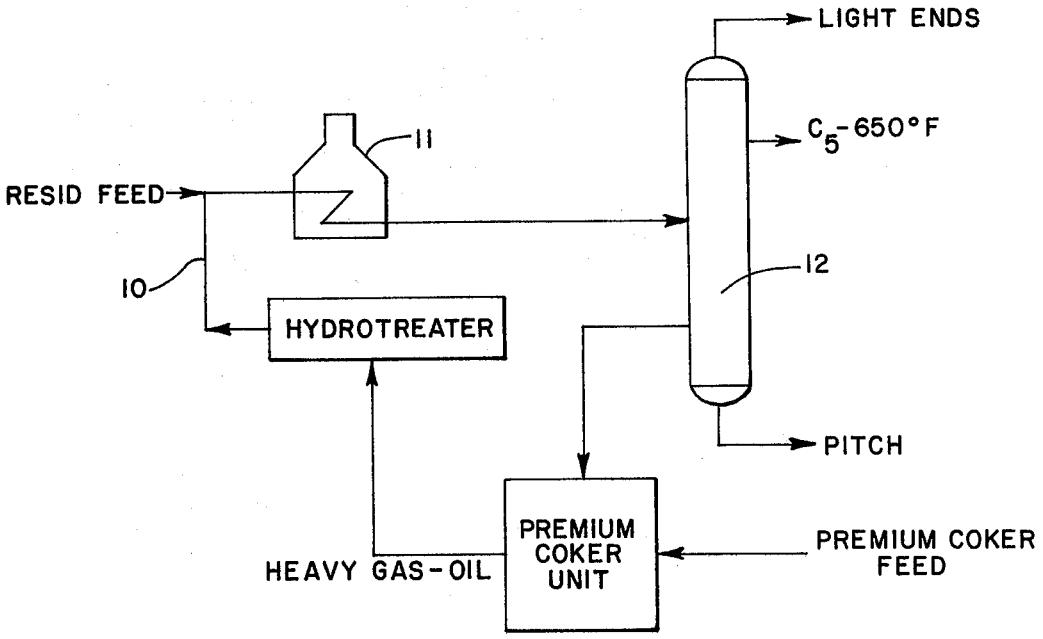
FIG. 2 is a schematic flow sheet illustrating a variation of the process of the invention in which the hydrogen donor diluent is recycled through a premium coker.

The process illustrated in FIG. 2 is identical to the process of FIG. 1 except that the gas-oil stream from fractionator 12 is passed to a premium coker unit to remove components in the donor diluent recycle stream that might have a high propensity to form coke, thereby further reducing the amount of coke desposition in the cracking furnace. As is clear from FIG. 2, the diluent stream which is passed to the hydrotreater is a heavy gas-oil fraction from a premium coker unit.

Figure 3:
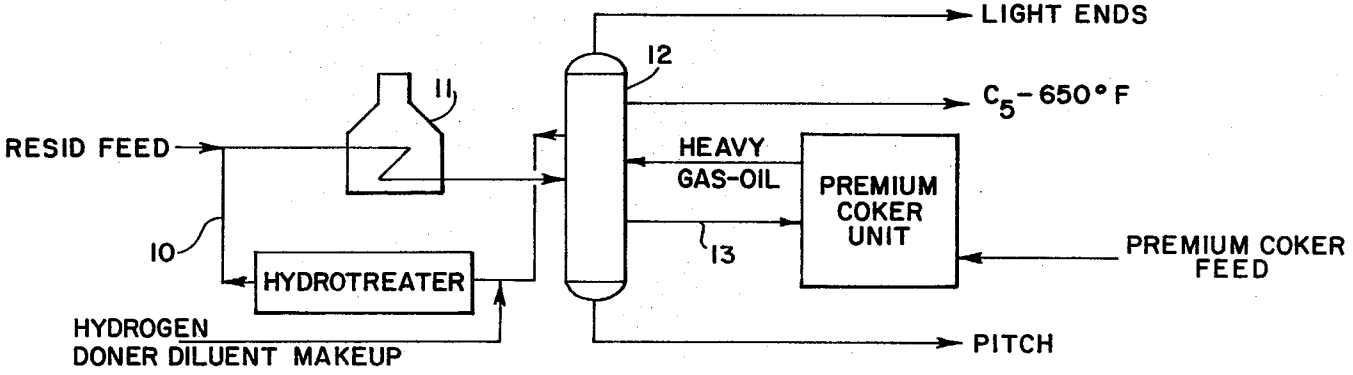
FIG. 3 is a schematic flow sheet illustrating a further variation of the invention in which a side stream is taken from a fractionator and fed to a premium coker, with the premium coker gas oil being returned to the fractionator and subsequently recycled to the hydrotreater.

The embodiment illustrated in FIG. 3 is quite similar to that described above with reference to FIG. 2, except that the vapor stream from the premium coker including the heavy gas-oil is returned to the fractionator before being recycled to the hydrotreater, and a side stream from the fractionator is passed via line 13 to the premium coke unit.

It is essential in the process of this invention that the donor diluent be a heavy gas-oil from a premium coker unit, as distinguished from a regular coker unit. Premium cokers, as mentioned above, and as is well understood by those familiar with the coking art, utilize an aromatic feedstock such as a thermal tar, an ethylene tar, or decant oil from a fluid catalytic cracking operation. Premium cokers generally operate with overhead vapor temperatures of about 840°-880° F and at drum pressures of from 30 to 70 psig. The heavy gas-oil from a premium coker operation is generally a 650° F-plus stream which essentially is the overhead vapor stream from the coke drum with the light ends removed by fractionation. The boiling range of the heavy gas-oil is typically from about 650° F to about 900° F. Premium coker gas-oil largely consists of condensed aromatic compounds having several unsaturated rings and some saturated rings plus aliphatic branch chains. The unsaturated portions of the molecules readily accept hydrogen during passage through the hydrotreater, and readily give up the hydrogen to the cracked products formed in the cracking furnace. The dehydrogenated donor diluent is then recovered by fractionation for recycle through the hydrotreater or in some cases it is first passed to a premium coker. Depending on conditions in the cracking furnace and on the exact nature of the donor diluent and the residual oil feedstock, donor diluent may need to be continuously added to or bled from the donor diluent recycle stream, depending on whether there is a net loss or production of donor diluent in the cracking furnace.

The following example is illustrative of the operation of an HDDC process in accordance with the most preferred embodiment of the invention.

EXAMPLE I

A residual oil obtained by taking the 950° F-plus bottoms from a vacuum still is blended with an equal amount of heavy premium coker gas-oil which has been hydrogenated in a hydrotreater. The combined residual oil and coker gas-oil donor diluent is fed to a furnace at a pressure of 400 psig. The furnace operating temperature is 975° F, and the residence time in the furnace is about one minute. The cracked products from the furnace are passed to a fractionator where they are separated into light-ends, a gasoline fraction, a bottoms pitch stream and a gas-oil stream. The gas-oil stream is recycled to the hydrotreater where it is hydrogenated for reuse in the process.

I claim:

1. In a thermal cracking process for converting heavy petroleum residual oil to lighter distillate products in which the thermal cracking of the residual oil takes place in the presence of a hydrogen donor diluent, the improvement wherein the hydrogen donor diluent comprises hydrotreated heavy premium coker gas-oil produced in a premium coking operation utilizing a coke drum pressure of from 10 to 150 psig, a coker furnace transfer line temperature of from 900° to 960° F and a coke drum overhead vapor temperature of from 825° to 900° F and operated at conditions such that the coke produced has a coefficient of thermal expansion of about 5 times $10^{-7}/°$ C or less.

2. The process of claim 1 wherein the products of the thermal cracking process are fractionated, the gas-oil fraction is passed through a hydrotreater in which said fraction is hydrotreated, and the hydrotreated fraction is recycled as hydrogen donor diluent in said thermal cracking process.

3. The process of claim 1 wherein the products of the thermal cracking process are fractionated, the gas-oil fraction passed to a premium coker unit, heavy premium coker gas-oil from said coker unit is passed to a hydrotreater for hydrogenation thereof, and the hydrogenated premium coker gas-oil is utilized as hydrogen donor diluent in said thermal cracking process.

4. The process of claim 1 wherein the products of the thermal cracking process are fractionated, a side stream from said fractionation is passed to a premium coker unit, vapors from said premium coker are returned to said fractionator, and a gas-oil fraction from said fractionator is passed to a hydrotreater for hydrogenation and subsequent reuse as hydrogen donor diluent in said process.

5. The process of claim 1 wherein said hydrogen donor diluent is a heavy premium coker gas-oil having a boiling range of from 650° to 900° F.

6. The process of claim 1 wherein said hydrogen donor diluent consists essentially of a mixture of:

(a) premium coker gas-oil taken directly from a premium coker unit; and (b) a recycled fraction boiling in the gas-oil range and obtained by fractionation of the products from said thermal cracking process.

7. The process of claim 1 wherein about one volume of diluent is added to each volume of residual oil fed to said thermal cracking process.

8. The process of claim 1 wherein the heavy premium coker gas-oil is produced in a premium coking operation utilizing a coke drum pressure of from 30 to 70 psig, a transfer line temperature of from 920°945° F and a coke drum overhead vapor temperature of from 840° to 880° F.

* * * * *